US010022768B2

(12) United States Patent
Imamura et al.

(10) Patent No.: US 10,022,768 B2
(45) Date of Patent: Jul. 17, 2018

(54) SPINNING FORMING DEVICE

(71) Applicant: KAWASAKI JUKOGYO KABUSHIKI KAISHA, Kobe-shi, Hyogo (JP)

(72) Inventors: Yoshihide Imamura, Kobe (JP); Yuto Sakane, Kobe (JP); Kohei Mikami, Akashi (JP); Hayato Iwasaki, Kobe (JP); Hiroshi Kitano, Kobe (JP)

(73) Assignee: KAWASAKI JUKOGYO KABUSHIKI KAISHA, Kobe-shi (JP)

( * ) Notice: Subject to any disclaimer, the term of this patent is extended or adjusted under 35 U.S.C. 154(b) by 0 days.

(21) Appl. No.: 15/112,028

(22) PCT Filed: Jan. 8, 2015

(86) PCT No.: PCT/JP2015/000056
§ 371 (c)(1),
(2) Date: Jul. 15, 2016

(87) PCT Pub. No.: WO2015/118795
PCT Pub. Date: Aug. 13, 2015

(65) Prior Publication Data

US 2016/0325334 A1 Nov. 10, 2016

(30) Foreign Application Priority Data

Feb. 4, 2014 (JP) ..... 2014-019324

(51) Int. Cl.
*B21D 22/14* (2006.01)
*B21D 37/16* (2006.01)
*B21D 37/18* (2006.01)

(52) U.S. Cl.
CPC ..... *B21D 22/14* (2013.01); *B21D 37/16* (2013.01); *B21D 37/18* (2013.01)

(58) Field of Classification Search
CPC ..... B21D 22/14; B21D 22/16; B21D 22/18
See application file for complete search history.

(56) References Cited

U.S. PATENT DOCUMENTS 3,815,395 A 6/1974 Sass
2001/0039864 A1* 11/2001 Yoshitome ..... B21D 22/14 83/13

FOREIGN PATENT DOCUMENTS

CN 1947932 A 4/2007
DE 10 2007 012 765 B4 3/2013
(Continued)

OTHER PUBLICATIONS

Feb. 16, 2017 Office Action issued in Chinese Patent Application No. 201580004278.9.
(Continued)

*Primary Examiner* — Debra Sullivan
(74) *Attorney, Agent, or Firm* — Oliff PLC

(57) ABSTRACT

A spinning forming device includes: a receiving jig supporting a central portion of a plate to be formed; and a rotating shaft to which the receiving jig is attached. Further, the spinning forming device includes: a heater that locally heats a transform target portion of the plate by induction heating; and a processing roller that presses the transform target portion to transform the plate. Furthermore, the spinning forming device includes a cooling device and/or a lubricant supply device. The cooling device sprays a cooling gas toward the processing roller. The lubricant supply device supplies a lubricant onto the processing roller or to between the processing roller and the plate.

14 Claims, 8 Drawing Sheets

(56) References Cited

FOREIGN PATENT DOCUMENTS

| | | | |
|---|---|---|---|
| EP | 1775043 | A1 | 4/2007 |
| JP | S48-41965 | A | 6/1973 |
| JP | 2003-334626 | A | 11/2003 |
| JP | 2006-095536 | A | 4/2006 |
| JP | 2011-218427 | A | 11/2011 |
| SU | 428 822 | A1 | 5/1974 |

OTHER PUBLICATIONS

Mar. 31, 2015 International Search Report issued in International Patent Application No. PCT/JP2015/000056.
Aug. 9, 2016 International Preliminary Report on Patentability issued in International Patent Application No. PCT/JP2015/000056.
Sep. 14, 2017 Search Report issued in European Patent Application No. 15746328.2.

* cited by examiner

SPINNING FORMING DEVICE

TECHNICAL FIELD

The present invention relates to a spinning forming device for forming a plate in a desired shape while rotating the plate.

BACKGROUND ART

Conventionally known is a spinning forming device designed to transform a plate by pressing a processing tool against the plate while rotating the plate. The spinning forming device normally includes a mandrel (shaping die) attached to a rotating shaft and performs forming in such a manner that the plate is pressed against the mandrel by the processing tool.

In recent years, proposed is a spinning forming device designed to perform spinning forming while locally heating the plate. For example, as a spinning forming device for a titanium alloy, PTL 1 discloses a spinning forming device configured such that a portion of the plate which is pressed against the mandrel by a spatula (processing tool) is heated by high frequency induction heating.

CITATION LIST

Patent Literature

PTL 1: Japanese Laid-Open Patent Application Publication No. 2011-218427

SUMMARY OF INVENTION

Technical Problem

The inventors of the present invention have found that by locally heating the plate by induction heating, the plate can be transformed into a final shape in a floating state without using the mandrel. From this point of view, in an application (Japanese Patent Application No. 2012-178269) preceding the present application, the applicant of the present application has proposed a spinning forming device using, instead of the mandrel, a receiving jig supporting a central portion of the plate. According to this spinning forming device, at a position away from the receiving jig, a transform target portion of the plate is heated by a heater and is pressed by the processing tool.

When using the mandrel, the transform target portion of the plate is pressed against the mandrel by the processing tool. Therefore, heat applied to the plate by the induction heating is immediately released to the mandrel. On the other hand, when using the receiving jig, the transform target portion of the plate is located away from the receiving jig. Therefore, heat applied to the plate by the induction heating tends to stay at the transform target portion that is a locally heated place. As a result, a part of a plate material of the plate may be separated from the plate and adhere to the processing tool. To prevent the plate material from adhering to the processing tool, it is desirable to use, as the processing tool, a processing roller that rotates together with the plate. However, even when the processing roller is used, it is desired to further suppress adhering of the plate material to the processing roller.

An object of the present invention is to provide a spinning forming device capable of suppressing adhering of the plate material to the processing roller.

Solution to Problem

To solve the above problem, one aspect of the present invention provides a spinning forming device comprising: a receiving jig supporting a central portion of a plate to be formed; a rotating shaft to which the receiving jig is attached; a heater that locally heats a transform target portion of the plate by induction heating; a processing roller that presses the transform target portion to transform the plate; and a cooling device that sprays a cooling gas toward the processing roller.

According to the above configuration, since the processing roller is cooled, adhering of a plate material to the processing roller can be suppressed. In addition, since the cooling gas is sprayed toward the processing roller, the plate is not directly cooled by the cooling gas. Thus, excellent formability by local heating can be maintained.

The spinning forming device may be configured such that the cooling device sprays the cooling gas in a direction opposite to a rotational direction of the processing roller. According to this configuration, the speed of the cooling gas relative to the processing roller can be increased by utilizing the rotation of the processing roller. Thus, a cooling effect can be improved.

The spinning forming device may be configured such that: in a peripheral edge portion of the processing roller, a semicircular-arc region close to the transform target portion is defined as a plate-side region, and a semicircular-arc region far from the transform target portion is defined as an opposite plate-side region; and the cooling device sprays the cooling gas toward the opposite plate-side region of the processing roller. According to this configuration, a decrease in a temperature of the plate by the cooling gas (i.e., indirect cooling of the plate) can be effectively suppressed.

The spinning forming device may further include a lubricant supply device that supplies a lubricant onto the processing roller or to between the processing roller and the plate. According to this configuration, since friction between the plate and the processing roller is reduced by the lubricant, the adhering of the plate material to the processing roller can be more effectively suppressed.

The spinning forming device may be configured such that: the heater heats the transform target portion to not less than 700° C.; and the lubricant is a solid lubricant to be scattered onto the processing roller. If a liquid lubricant is used when heating the transform target portion of the plate to a high temperature, an undesired result may be caused in the liquid lubricant. On the other hand, by using a solid lubricant when heating the transform target portion of the plate to a high temperature, an adequate lubricating effect can be obtained even under a high-temperature environment.

Another aspect of the present invention provides a spinning forming device including: a receiving jig supporting a central portion of a plate to be formed; a rotating shaft to which the receiving jig is attached; a heater that locally heats a transform target portion of the plate by induction heating; a processing roller that presses the transform target portion to transform the plate; and a lubricant supply device that supplies a lubricant onto the processing roller or to between the processing roller and the plate.

According to the above configuration, since the friction between the plate and the processing roller is reduced by the lubricant, the adhering of the plate material to the processing roller can be suppressed. By supplying the lubricant onto the processing roller, the decrease in the temperature of the plate by the supply of the lubricant can be reduced. Thus, the excellent formability by the local heating can be maintained.

The spinning forming device may be configured such that: the heater heats the transform target portion to not less than 700° C.; and the lubricant is a solid lubricant to be scattered onto the processing roller. If the liquid lubricant is used when heating the transform target portion of the plate to a high temperature, an undesired result may be caused in the liquid lubricant. On the other hand, by using the solid lubricant when heating the transform target portion of the plate to a high temperature, the lubricating effect can be obtained even under a high-temperature environment.

The spinning forming device may be configured such that: the processing roller has a trapezoidal cross section that decreases in diameter toward a direction away from the rotating shaft; and a center axis of the processing roller is set such that a large-diameter portion of the processing roller is in point contact with the plate, and an angle between a side surface of the processing roller and a radial direction of the rotating shaft is not less than 1° and not more than 30°. According to this configuration, a load necessary for pressing of the processing roller can be prevented from excessively increasing, and upward warpage of an outside portion of the plate can be restricted, the outside portion being located outside the transform target portion.

The spinning forming device may further include a scraper that scrapes a plate material adhering to the processing roller. According to this configuration, even if the plate material adheres to the processing roller, the adhering plate material can be removed. As a result, accuracy of a final shape (i.e., forming accuracy) can be improved.

The spinning forming device may be configured such that the heater is disposed at an opposite side of the processing roller across the plate. According to this configuration, regardless of the shape of the plate during processing, the heater can be positioned immediately close to the transform target portion of the plate and appropriately heat the transform target portion.

Advantageous Effects of Invention

The present invention can suppress the adhering of the plate material to the processing roller.

DESCRIPTION OF EMBODIMENTS

Embodiment 1

Figure 1:
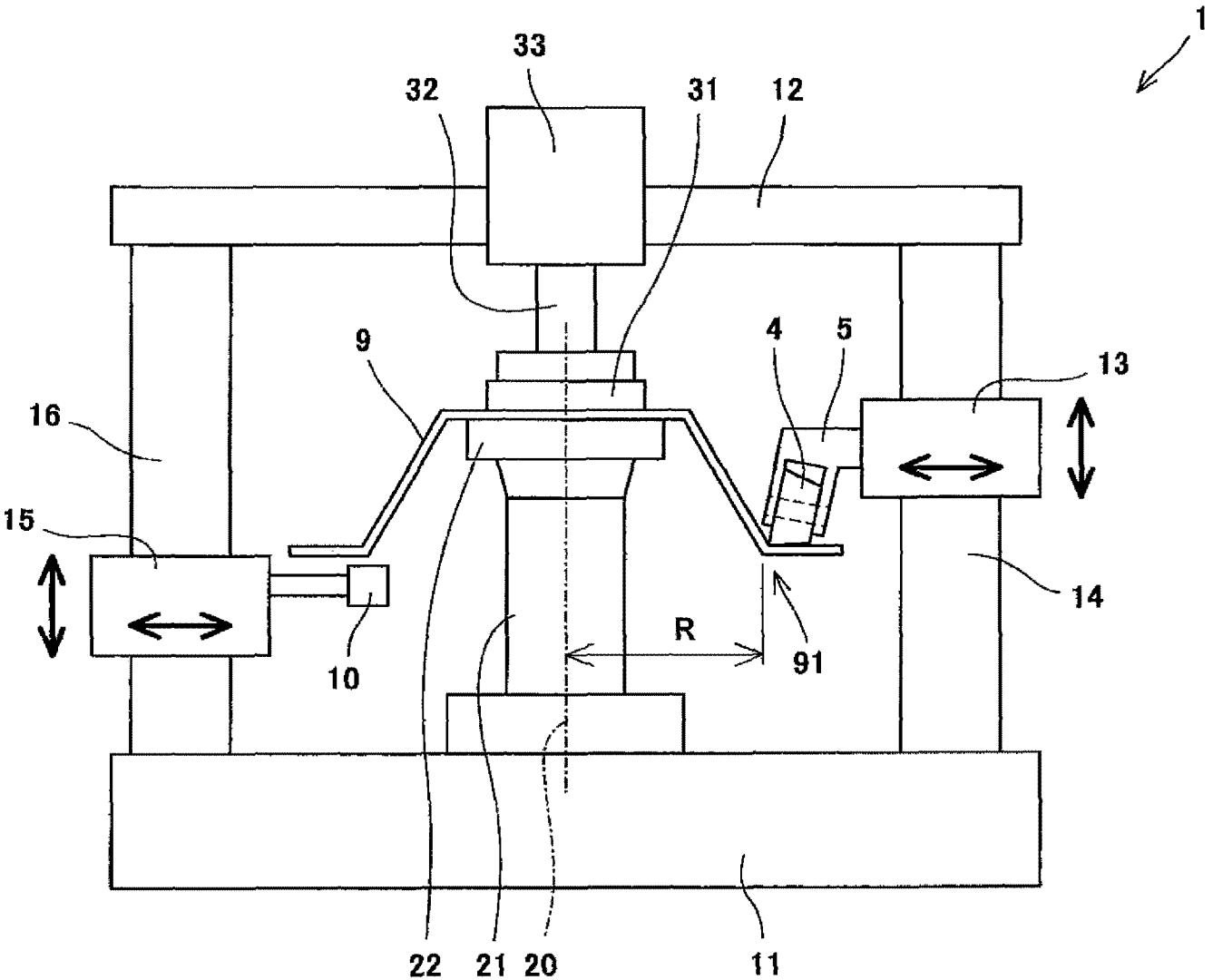
FIG. 1 is a schematic configuration diagram showing a spinning forming device according to Embodiment 1 of the present invention.

FIG. 1 shows a spinning forming device 1 according to Embodiment 1 of the present invention. The spinning forming device 1 includes a rotating shaft 21, a receiving jig 22 attached to the rotating shaft 21, and a fixing jig 31. The receiving jig 22 supports a central portion of a plate 9 to be formed, and the fixing jig 31 sandwiches the plate 9 together with the receiving jig 22. The spinning forming device 1 further includes: a heater 10 that locally heats a transform target portion 91 of the plate 9 by induction heating, the transform target portion 91 being located away from a center axis 20 of the rotating shaft 21 by a predetermined distance R; and a processing roller 4 that presses the transform target portion 91 to transform the plate 9.

An axial direction of the rotating shaft 21 (i.e., a direction in which the center axis 20 extends) is a vertical direction in the present embodiment. However, the axial direction of the rotating shaft 21 may be a horizontal direction or an oblique direction. A lower portion of the rotating shaft 21 is supported by a base 11. A motor (not shown) that rotates the rotating shaft 21 is disposed in the base 11. An upper surface of the rotating shaft 21 is flat, and the receiving jig 22 is fixed to the upper surface of the rotating shaft 21.

The plate 9 is, for example, a flat circular plate. However, the shape of the plate 9 may be a polygonal shape or an oval shape. The plate 9 is not necessarily flat over the entirety. For example, the central portion of the plate 9 may be thicker than a peripheral edge portion of the plate 9, or the entire plate 9 or a part of the plate 9 may be processed in advance to have a tapered shape. A material of the plate 9 is not especially limited and is, for example, a titanium alloy.

The receiving jig 22 has a size within a circle defined by a forming start position of the plate 9. For example, in a case where the receiving jig 22 has a disc shape, a diameter of the receiving jig 22 is equal to or smaller than a diameter of the circle defined by the forming start position of the plate 9. Unlike conventional mandrels, the plate 9 is not transformed by being pressed against a radially outer side surface of the receiving jig 22.

The fixing jig 31 is attached to a pressurizing rod 32. The pressurizing rod 32 is driven by a driving portion 33 in an upward/downward direction to press the plate 9 against the receiving jig 22 via the fixing jig 31. For example, the pressurizing rod 32 and the driving portion 33 constitute a hydraulic cylinder. The driving portion 33 is fixed to a frame 12 disposed above the rotating shaft 21, and a bearing rotatably supporting the pressurizing rod 32 is incorporated in the driving portion 33.

It should be noted that the pressurizing rod 32 and the driving portion 33 are not necessarily required. For example, the fixing jig 31 may be fixed to the receiving jig 22 together with the plate 9 by fastening members, such as bolts or clamps. Or, the fixing jig 31 may be omitted, and the plate 9 may be directly fixed to the receiving jig 22 by, for example, bolts.

In the present embodiment, the processing roller 4 that presses the transform target portion 91 of the plate 9 is disposed above the plate 9, and the plate 9 is processed by the processing roller 4 in a downwardly opening shape that accommodates the receiving jig 22. To be specific, an upper surface of the plate 9 is a front surface, and a lower surface of the plate 9 is a rear surface. However, the processing roller 4 may be disposed under the plate 9, and the plate 9 may be processed by the processing roller 4 in an upwardly opening shape that accommodates the fixing jig 31. Or, to form a projection(s) and a depression(s) on the plate 9, the position of the processing roller 4 may be changed from the upper side of the plate 9 to the lower side of the plate 9 or vice versa in the middle of the processing of the plate 9.

In the present embodiment, the heater 10 that heats the transform target portion 91 of the plate 9 is disposed under the plate 9. In other words, the heater 10 is located on the opposite side of the processing roller 4 across the plate 9. However, the heater 10 may be disposed above the plate 9 so as to be located at the same side as the processing roller 4 relative to the plate 9.

The relative positions of the heater 10 and the processing roller 4 are not especially limited as long as they are located on substantially the same circumference around the center axis 20 of the rotating shaft 21. For example, the heater 10 and the processing roller 4 may be located at respective positions opposed to each other across the center axis 20 of the rotating shaft 21.

The processing roller 4 is rotatably supported by an arm 5. The processing roller 4 and the arm 5 are moved by a radial direction movement mechanism 13 in a radial direction of the rotating shaft 21 and are also moved by an axial direction movement mechanism 14 through the radial direction movement mechanism 13 in the axial direction of the rotating shaft 21. The axial direction movement mechanism 14 extends so as to couple the base 11 and the frame 12. It should be noted that components around the processing roller 4 will be described later in detail.

The heater 10 is moved by a radial direction movement mechanism 15 in the axial direction of the rotating shaft 21 and is also moved by an axial direction movement mechanism 16 in the axial direction of the rotating shaft 21 through the radial direction movement mechanism 15. The axial direction movement mechanism 16 extends so as to couple the base 11 and the frame 12.

For example, a displacement meter (not shown) is attached to the heater 10. The displacement meter measures a distance to the transform target portion 91 of the plate 9. The heater 10 is moved in the axial direction and radial direction of the rotating shaft 21 in conjunction with the movement of the processing roller 4 such that a measured value of the displacement meter becomes constant.

Figure 2A:
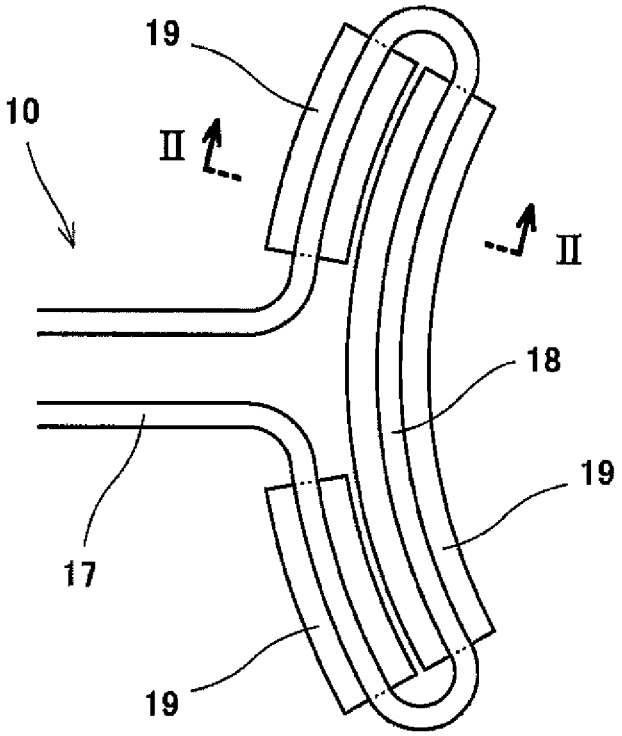
FIG. 2A is a plan view showing a heater.
Figure 2B:
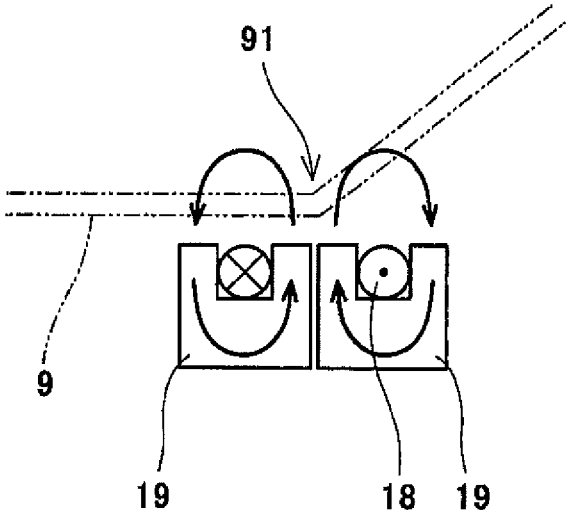
FIG. 2B is a cross-sectional view taken along line II-II of FIG. 2A.

As shown in FIGS. 2A and 2B, the heater 10 includes: an electric conducting pipe 17 having a doubled circular-arc coil portion 18 extending in a circumferential direction of the rotating shaft 21; and a core 19 for collecting magnetic flux generated around the coil portion 18. An alternating voltage is applied to the electric conducting pipe 17. Further, a cooling liquid flows inside the electric conducting pipe 17. The coil portion 18 includes a pair of circular-arc portions which are parallel to each other along the plate 9, in other words, which are separated from each other in the radial direction of the rotating shaft 21. The core 19 is supported by a supporting plate, not shown.

A frequency of the alternating voltage applied to the electric conducting pipe 17 is not especially limited but is desirably a high frequency of 5 k to 400 kHz. To be specific, the induction heating performed by the heater 10 is desirably high frequency induction heating.

A temperature at which the heater 10 heats the transform target portion 91 of the plate 9 is not especially limited. However, for example, when the plate 9 is made of a titanium alloy, steel, stainless steel, a Ni alloy, a copper alloy, or the like, the transform target portion 91 of the plate 9 is heated by the heater 10 to a high temperature of not less than 700° C.

Figure 3A:
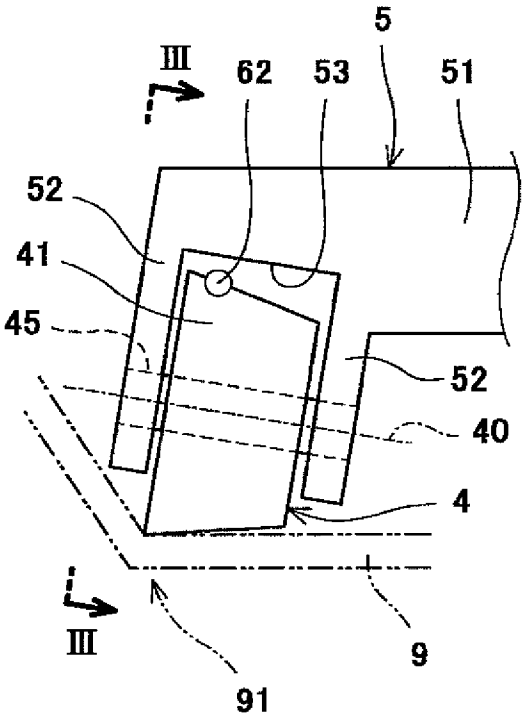
FIG. 3A is an enlarged side view showing a processing roller and components around the processing roller.
Figure 3B:
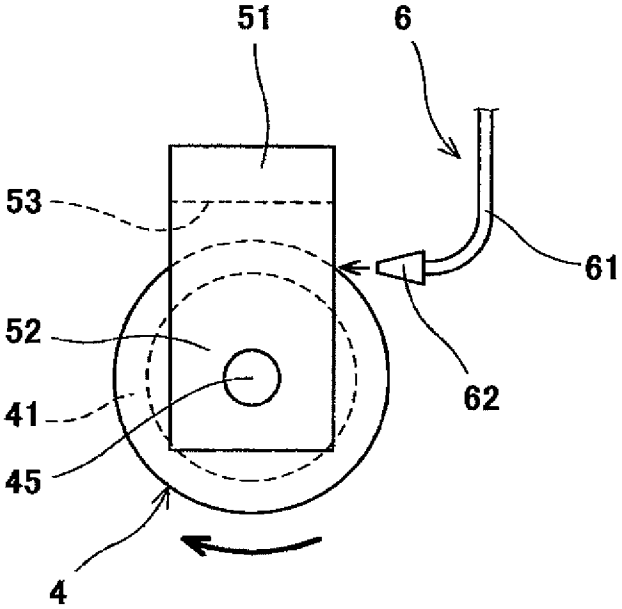
FIG. 3B is a view showing the processing roller and the components around the processing roller when viewed from a direction indicated by line of FIG. 3A.

Next, the components around the processing roller 4 will be explained in detail in reference to FIGS. 3A and 3B.

In the present embodiment, the processing roller 4 has a trapezoidal cross section that decreases in diameter toward a direction away from the rotating shaft 21. To be specific, the processing roller 4 includes: a large-diameter bottom surface at the rotating shaft 21 side; a small-diameter top surface at an opposite side of the rotating shaft 21; and a tapered side surface 41 connecting the bottom surface and the top surface. To be specific, a corner portion between the side surface 41 and the bottom surface is referred to as a large-diameter portion, and a corner portion between the side surface 41 and the top surface is referred to as a small-diameter portion.

A center axis 40 of the processing roller 4 is set such that: the large-diameter portion of the processing roller 4 is in point contact with the plate 9; and an angle between the side surface 41 of the processing roller 4 and the radial direction of the rotating shaft 21 is not less than 1° and not more than 30°. In the present embodiment, the processing roller 4 is slightly inclined outward in the radial direction of the rotating shaft 21 such that the top surface of the processing roller 4 is not perpendicular to the radial direction of the rotating shaft 21 but faces obliquely downward. It should be noted that the center axis 40 of the processing roller 4 may be parallel to the radial direction of the rotating shaft 21 or may be inclined opposite to FIG. 3A.

The arm 5 supports the processing roller 4 through a rotating shaft 45 and a bearing, not shown. To be specific, the center axis 40 of the processing roller 4 corresponds to a center line of the rotating shaft 45.

Specifically, the arm 5 includes: a main body 51 extending in the radial direction of the rotating shaft 21; and a pair of projecting pieces 52 projecting obliquely downward from the main body 51 so as to face the respective top and bottom surfaces of the processing roller 4. The main body 51 includes a retreating surface 53 located between the projecting pieces 52 and facing the side surface 41 of the processing roller 4. Both end portions of the rotating shaft 45 are supported by the respective projecting pieces 52. The bearing, not shown, may be interposed between the rotating shaft 45 and the processing roller 4 (in this case, the rotating shaft 45 does not rotate) or may be interposed between the rotating shaft 45 and each projecting piece 52 (in this case, the rotating shaft 45 rotates).

The spinning forming device 1 further includes a cooling device 6 that sprays a cooling gas toward the processing roller 4. A portion of the processing roller 4 to which the cooling gas is sprayed may be an entire region in the inclination direction (region on a line connecting the top and bottom surfaces of the processing roller 4 at the shortest distance) of the side surface 41 or may be a portion of the side surface 41 which is close to the large-diameter portion. The cooling gas is not especially limited, and examples thereof include air, carbon dioxide, nitrogen, and argon.

In a peripheral edge portion (the side surface 41 in the present embodiment) of the processing roller 4, a semicircular-arc region close to the transform target portion 91 is defined as a plate-side region, and a semicircular-arc region far from the transform target portion 91 is defined as an opposite plate-side region. In this case, it is desirable that the cooling device 6 spray the cooling gas toward the opposite plate-side region of the processing roller 4. According to this configuration, a decrease in a temperature of the plate 9 by the cooling gas (i.e., indirect cooling of the plate 9) can be effectively suppressed. It is more desirable that a position of the peripheral edge portion of the processing roller 4 to which the cooling gas is sprayed be located within a middle part among three equally divided parts of the opposite plate-side region.

In the present embodiment, the cooling device 6 sprays the cooling gas to the processing roller 4 in a direction opposite to a rotational direction of the processing roller 4. More specifically, the cooling device 6 includes: a nozzle 62 that emits the cooling gas; a tube 61 through which the cooling gas is introduced to the nozzle 62; and a blast machine (such as a compressor or a blower; not shown) that supplies the cooling gas to the tube 61. In the present embodiment, as shown in FIG. 3B, the nozzle 62 is disposed at a right side of the projecting piece 52 (i.e., at a rotational direction downstream side of the processing roller 4 when viewed from the projecting piece 52) so as to emit the cooling gas leftward toward the vicinity of an uppermost portion of the processing roller 4. In other words, the cooling device 6 sprays the cooling gas toward the vicinity of an end portion of the processing roller 4, the end portion being located farthest from the transform target portion 91. It should be noted that in FIG. 3B for example, the nozzle 62 may be disposed at a left side of the projecting piece 52 (i.e., at a rotational direction upstream side of the processing roller 4 when viewed from the projecting piece 52) so as to emit the cooling gas downward toward the vicinity of a leftmost portion of the processing roller 4.

To reduce friction between the plate 9 and the processing roller 4, a solid lubricant such as a powder may be applied to the upper surface of the plate 9 in advance. Examples of the powder include a powder containing graphite as a major component, a powder containing boron nitride as a major component, and a mixture of these powders.

As explained above, in the spinning forming device 1 of the present embodiment, the processing roller 4 is cooled by the cooling gas from the cooling device 6. Therefore, adhering of a plate material of the plate to the processing roller 4 can be suppressed. In addition, since the cooling gas is sprayed toward the processing roller 4, the plate 9 is not directly cooled by the cooling gas. Thus, excellent formability by local heating can be maintained.

In the present embodiment, since the cooling gas is sprayed in a direction opposite to the rotational direction of the processing roller 4, the speed of the cooling gas relative to the processing roller 4 can be increased by utilizing the rotation of the processing roller 4. Thus, a cooling effect can be improved.

Further, in the present embodiment, since the heater 10 is disposed on the opposite side of the processing roller 4 across the plate 9, the heater 10 can be located immediately close to the transform target portion 92 of the plate 9 regardless of the shape of the plate 9 during processing. With this, the transform target portion 91 can be appropriately heated.

Furthermore, in the present embodiment, the processing roller 4 having the trapezoidal cross section is used, and the large-diameter portion of the processing roller 4 is in point contact with the plate 9. In addition, the angle between the side surface 41 of the processing roller 4 and the radial direction of the rotating shaft 21 is not less than 1° and not more than 30°. Therefore, a load necessary for pressing of the processing roller 4 is prevented from excessively increasing, and upward warpage of an outside portion of the plate 9 can be restricted, the outside portion being located outside the transform target portion 91. This effect will be explained in more detail in reference to FIG. 8.

Figure 8:
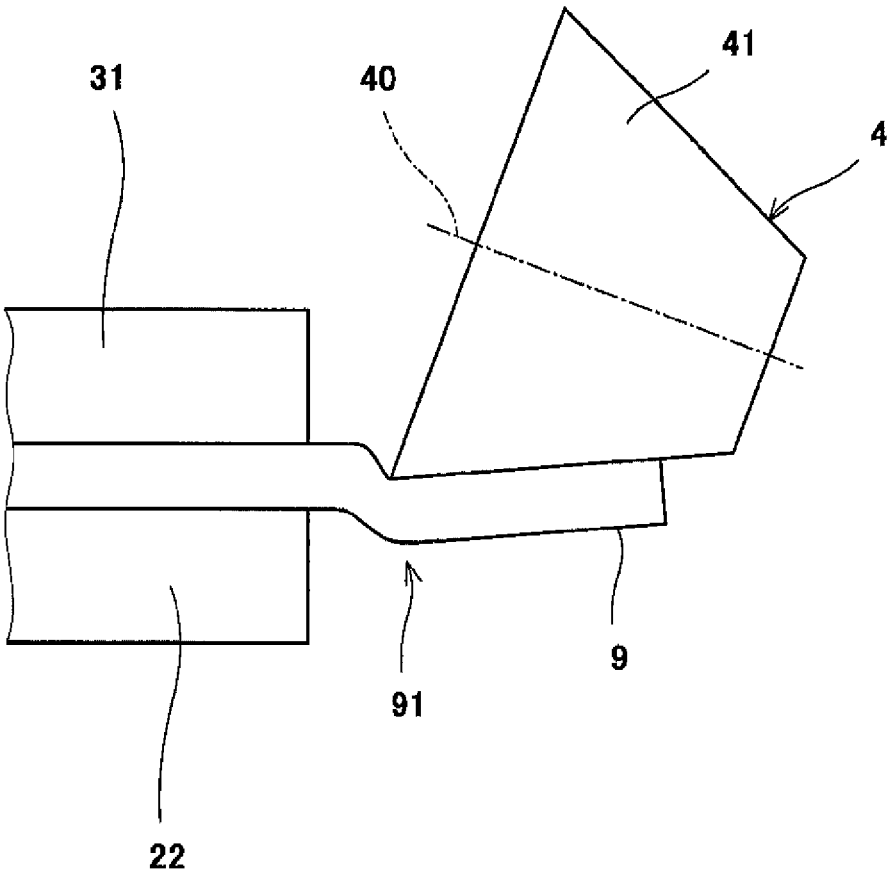
FIG. 8 is a diagram showing a behavior of a plate under a specific condition.

Under a specific condition, as shown in FIG. 8, the outside portion of the plate 9 may warp upward toward the processing roller 4 by pressing of the processing roller 4 during processing, the outside portion being located outside the transform target portion 91. FIG. 8 shows an initial stage of the forming, but the timing of the upward warpage of the plate 9 is not limited to the initial stage of the forming.

As described above, the outside portion of the plate 9 warps upward toward the processing roller 4, the outside portion being located outside the transform target portion 91. Therefore, when using a processing roller having a substantially rectangular cross section that is in line contact with the plate 9, the load necessary for the pressing of the processing roller excessively increases by the upward warpage of the plate 9. On the other hand, when using a processing roller including a circular-arc side surface having a small curvature radius, the upward warpage of the plate 9 cannot be restricted. Therefore, for example, when the heater 10 is disposed at the same side as the processing roller relative to the plate 9 or when another heater is disposed at the same side as the processing roller relative to the plate 9 in addition to the heater 10 disposed at the opposite side of the processing roller across the plate 9, the outside portion of the plate 9 may contact the heater located at an upper side, the outside portion being located outside the transform target portion 91.

On the other hand, as in the present embodiment, when the processing roller 4 having the trapezoidal cross section is used, and the center axis 40 of the processing roller 4 is set such that the angle between the side surface 41 and the radial direction of the rotating shaft 21 is not less than 1° and not more than 30°, the upward warpage of the plate 9 is allowed by this angle. As a result, the load necessary for the pressing of the processing roller 4 can be prevented from excessively increasing. In addition, the upward warpage of the plate 9 at an angle not less than the angle of the side surface 41 can be restricted by the side surface 41. With this, even when the heater is located above the plate 9, the outside portion of the plate 9 and the heater can be prevented from contacting each other, the outside portion being located outside the transform target portion 91.

It should be noted that the cross-sectional shape of the processing roller 4 may be any other shape, such as a substantially rhombic shape, a long round shape, a rounded-corner rectangular shape, depending on a forming condition of the plate 9. Even if the cooling device 6 is not provided, the above effects can be obtained only by the configuration in which the center axis 40 of the processing roller 4 having the trapezoidal cross section is set such that the angle between the side surface 41 of the processing roller 4 and the radial direction of the rotating shaft 21 is not less than 1° and not more than 30°.

Modified Example

Figure 4:
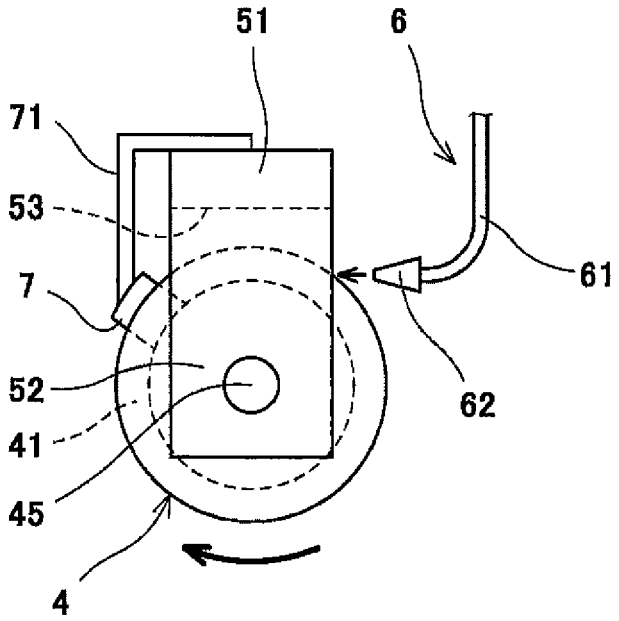
FIG. 4 is a diagram showing Modified Example of Embodiment 1.

As shown in FIG. 4, the spinning forming device 1 may include a scraper 7 that scrapes the plate material adhering to the processing roller 4. For example, the scraper 7 is attached to the main body 51 of the arm 5 through a bracket 71. When the processing roller 4 has the trapezoidal cross section, the scraper 7 may be in line contact with the entire region in the inclination direction (region on the line connecting the top and bottom surfaces of the processing roller 4 at the shortest distance) of the side surface 41 or may contact only the portion of the side surface 41 which is close to the large-diameter portion. As the scraper 7, a simple plate may be used, or a grinding stone, sand paper, or the like may be used.

According to this configuration, even if the plate material adheres to the processing roller 4, the adhering plate material can be removed. As a result, accuracy of a final shape (i.e., forming accuracy) can be improved. It should be noted that the spinning forming device 1 may include only the scraper 7 without including the cooling device 6.

Embodiment 2

Next, the spinning forming device according to Embodiment 2 of the present invention will be explained in reference to FIGS. 5A and 5B. In the present embodiment and Embodiment 3 described later, the same reference signs are used for the same components as in Embodiment 1, and a repetition of the same explanation is avoided.

In the present embodiment, the cooling device 6 includes: a passage 63 provided at the main body 51 of the arm 5; and a plurality (in the illustrated example, three) outlet ports 64 extending from the passage 63 toward the retreating surface 53 and opening on the retreating surface 53. The cooling gas is sprayed downward through the outlet ports 64 toward the processing roller 4.

Figure 6:
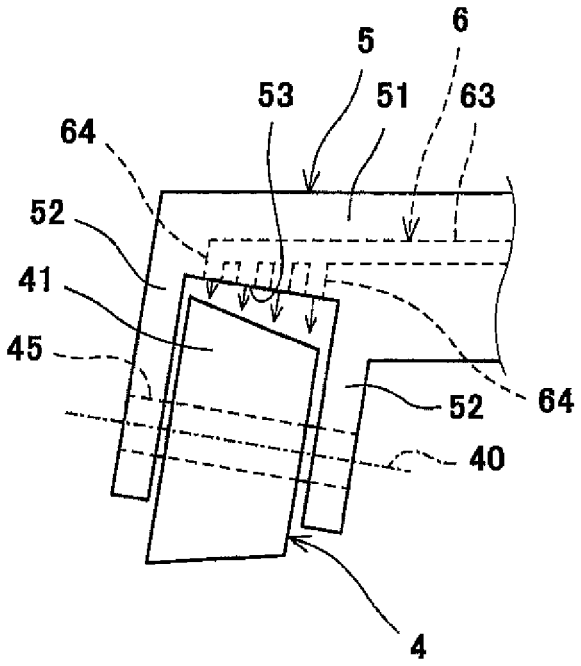
FIG. 6 is a diagram showing Modified Example of Embodiment 2.

In the present embodiment, the outlet ports 64 are lined up in the rotational direction of the processing roller 4. However, as shown in FIG. 6, the outlet ports 64 may be lined up in an axial direction of the processing roller 4. Or, the number of outlet ports 64 may be only one.

The same effects as in Embodiment 1 can be obtained even by the configuration of the present embodiment. As with Embodiment 1, needless to say, the solid lubricant may be applied to the upper surface of the plate 9 in advance.

Embodiment 3

Figure 7A:
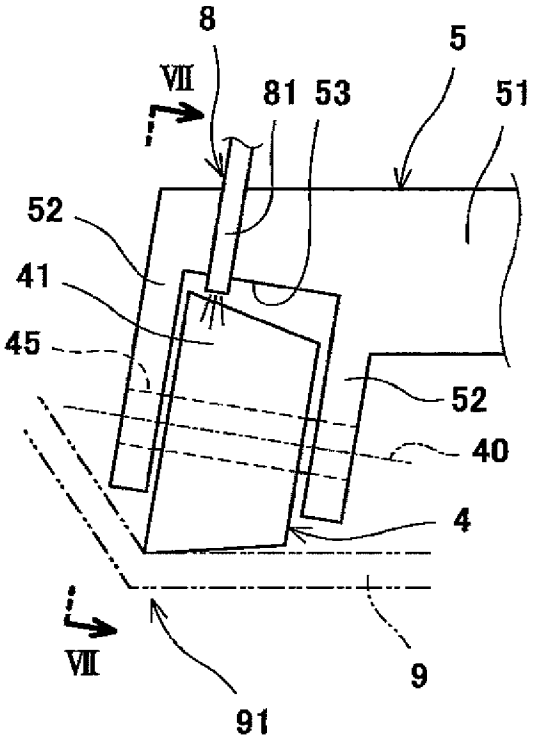
FIG. 7A is an enlarged side view showing the components around the processing roller in Embodiment 3 of the present invention.
Figure 7B:
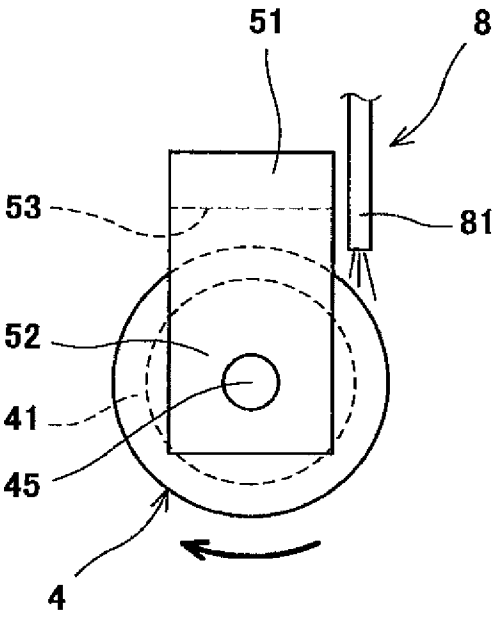
FIG. 7B is a view showing the components around the processing roller when viewed from a direction indicated by line VII-VII of FIG. 7A.

Next, the spinning forming device according to Embodiment 3 of the present invention will be explained in reference to FIGS. 7A and 7B. The spinning forming device of the present embodiment includes a lubricant supply device 8 instead of the cooling device 6.

In the present embodiment, the lubricant supply device 8 supplies a lubricant onto the processing roller 4. The lubricant may be a liquid lubricant such as lubricating oil or a solid lubricant such as a powder. Examples of the powder include a powder containing graphite as a major component, a powder containing boron nitride as a major component, and a mixture of these powders.

When the transform target portion 91 of the plate 9 is heated to a high temperature of not less than 700° C., it is desirable to use the solid lubricant as the lubricant. In this case, the lubricant supply device 8 scatters the solid lubricant onto the processing roller 4. If the liquid lubricant is used when heating the transform target portion 91 of the plate 9 to the high temperature, an undesired result may be caused in the liquid lubricant. On the other hand, if the solid lubricant is used when heating the transform target portion 91 of the plate 9 to the high temperature, a lubricating effect can be obtained even under a high-temperature environment.

A portion of the processing roller 4 to which the lubricant is supplied may be the entire region in the inclination direction (region on the line connecting the top and bottom surfaces of the processing roller 4 at the shortest distance) of the side surface 41 or the portion of the side surface 41 which is close to the large-diameter portion.

More specifically, the lubricant supply device 8 includes: a storage (not shown) that stores the lubricant; and a supply pipe 81 through which the lubricant is introduced from the storage to the processing roller 4. In the present embodiment, as shown in FIG. 7B, the supply pipe 81 is disposed at a right side of the projecting piece 52 (i.e., at a rotational direction downstream side of the processing roller 4 when viewed from the projecting piece 52) such that the lubricant is ejected downward toward the vicinity of a rightmost portion of the processing roller 4, in other words, such that a direction in which the lubricant is ejected becomes the same as the rotational direction of the processing roller 4. It should be noted that in FIG. 7B for example, the supply pipe 81 may be disposed at a left side of the projecting piece 52 (i.e., at a rotational direction upstream side of the processing roller 4 when viewed from the projecting piece 52) so as to eject the lubricant rightward toward the vicinity of an uppermost portion of the processing roller 4.

In the present embodiment, since the friction between the plate 9 and the processing roller 4 is reduced by the lubricant, the adhering of the plate material to the processing roller 4 can be suppressed. Further, in the present embodiment, since the lubricant is supplied onto the processing roller 4, the decrease in the temperature of the plate 9 by the supply of the lubricant can be reduced. Thus, the excellent formability by the local heating can be maintained.

Even in a case where the lubricant supply device 8 is adopted as in the present embodiment, the solid lubricant may be applied to the upper surface of the plate 9 in advance as explained in Embodiment 1.

Modified Example

The lubricant supply device 8 may be configured to supply the lubricant to between the processing roller 4 and the plate 9. For example, in FIG. 7B, the supply pipe 81 may be disposed so as to eject the lubricant leftward toward the vicinity of a lowermost portion of the processing roller 4.

Figure 5A:
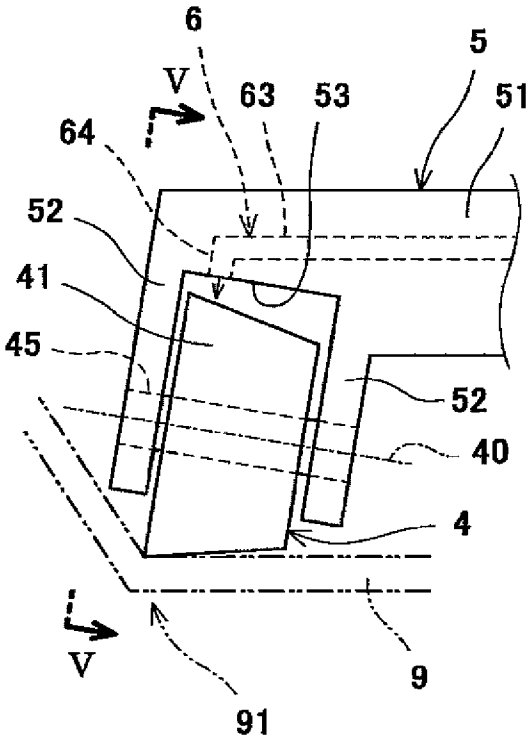
FIG. 5A is an enlarged side view showing the components around the processing roller in Embodiment 2 of the present invention.
Figure 5B:
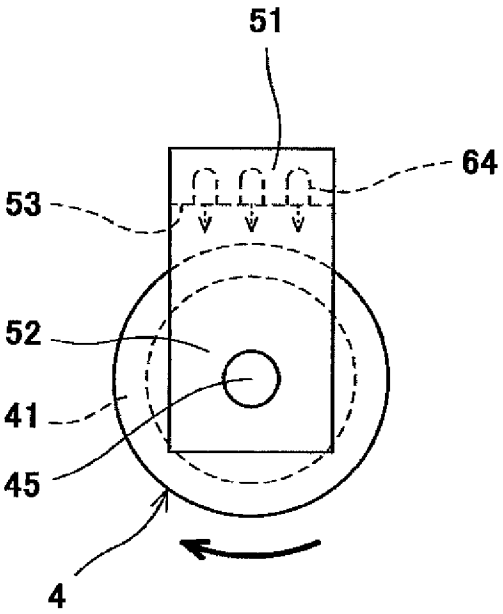
FIG. 5B is a view showing the components around the processing roller when viewed from a direction indicated by line V-V of FIG. 5A.

Further, as with the configurations shown in FIGS. 5A and 6, instead of the supply pipe 81, the lubricant supply device 8 may include: the passage 63 provided at the main body 51 of the arm 5; and one or a plurality of outlet ports 64 extending from the passage 63 toward the retreating surface 53 and opening on the retreating surface 53.

Needless to say, the lubricant supply device 8 can be combined with the cooling device 6 explained in Embodiment 1 or 2. The adhering of the plate material to the processing roller 4 can be more effectively suppressed by combining the lubricant supply device 8 with the cooling device 6.

Further, the scraper 7 shown in FIG. 4 may be adopted in addition to the lubricant supply device 8, or all of the lubricant supply device 8, the cooling device 6, and the scraper 7 may be adopted.

INDUSTRIAL APPLICABILITY

The present invention is useful when performing spinning forming of plates made of various materials.

REFERENCE SIGNS LIST

1 spinning forming device
10 heater
21 rotating shaft
22 receiving jig
4 processing roller

41 side surface
6 cooling device
7 scraper
8 lubricant supply device
9 plate
91 transform target portion

The invention claimed is:

1. A spinning forming device comprising:
a receiving jig supporting a central portion of a plate to be formed;
a rotating shaft to which the receiving jig is attached;
a heater that locally heats a transform target portion of the plate by induction heating;
a processing roller that, while being moved outward in a radial direction of the rotating shaft, presses the transform target portion to transform the plate to include a frusto-conical shape; and
a cooling device that sprays a cooling gas toward the processing roller, wherein:
the processing roller has a trapezoidal cross section that decreases in diameter toward a direction away from the rotating shaft; and
a center axis of the processing roller is set such that a large-diameter portion of the processing roller is in point contact with the plate, and an angle between a side surface of the processing roller and the radial direction of the rotating shaft is not less than 1° and not more than 30°, the side surface being a peripheral surface of the processing roller.

2. The spinning forming device according to claim 1, wherein the cooling device sprays the cooling gas in a direction opposite to a rotational direction of the processing roller.

3. The spinning forming device according to claim 1, wherein:
in a peripheral edge portion of the processing roller, a semicircular-arc region close to the transform target portion is defined as a plate-side region, and a semicircular-arc region far from the transform target portion is defined as an opposite plate-side region; and
the cooling device sprays the cooling gas toward the opposite plate-side region of the processing roller.

4. The spinning forming device according to claim 1, further comprising a lubricant supply device that supplies a lubricant onto the processing roller or to between the processing roller and the plate.

5. The spinning forming device according to claim 4, wherein:
the heater heats the transform target portion to not less than 700° C.; and
the lubricant is a solid lubricant to be scattered onto the processing roller.

6. The spinning forming device according to claim 1, further comprising a scraper that scrapes a plate material adhering to the processing roller.

7. The spinning forming device according to claim 1, wherein the heater is disposed at an opposite side of the processing roller across the plate.

8. The spinning forming device according to claim 1, wherein the processing roller presses the transform target portion to transform the plate while keeping a part of the plate flat with a shape that is perpendicular to a rotational axis of the jig.

9. The spinning forming device according to claim 1, wherein the processing roller presses the transform target portion to transform the plate while keeping a part of the plate flat, the part being located outside the transform target portion.

10. A spinning forming device comprising:
a receiving jig supporting a central portion of a plate to be formed;
a rotating shaft to which the receiving jig is attached;
a heater that locally heats a transform target portion of the plate by induction heating;
a processing roller that, while being moved outward in a radial direction of the rotating shaft, presses the transform target portion to transform the plate to include a frusto-conical shape; and
a lubricant supply device that supplies a lubricant onto the processing roller or to between the processing roller and the plate, wherein:
the processing roller has a trapezoidal cross section that decreases in diameter toward a direction away from the rotating shaft; and
a center axis of the processing roller is set such that a large-diameter portion of the processing roller is in point contact with the plate, and an angle between a side surface of the processing roller and the radial direction of the rotating shaft is not less than 1° and not more than 30°, the side surface being a peripheral surface of the processing roller.

11. The spinning forming device according to claim 10, wherein:
the heater heats the transform target portion to not less than 700° C.; and
the lubricant is a solid lubricant to be scattered onto the processing roller.

12. The spinning forming device according to claim 10, wherein the processing roller presses the transform target portion to transform the plate while keeping a part of the plate flat with a shape that is perpendicular to a rotational axis of the jig.

13. The spinning forming device according to claim 10, wherein the processing roller presses the transform target portion to transform the plate while keeping a part of the plate flat, the part being located outside the transform target portion.

14. A spinning forming device comprising:
a receiving jig supporting a central portion of a plate to be formed;
a rotating shaft to which the receiving jig is attached;
a heater that locally heats a transform target portion of the plate by induction heating;
a processing roller that presses the transform target portion to transform the plate;
a cooling device that sprays a cooling gas toward the processing roller; and
a scraper that scrapes a plate material adhering to the processing roller.

* * * * *